US008594534B2

(12) United States Patent
Saito et al.

(10) Patent No.: US 8,594,534 B2
(45) Date of Patent: Nov. 26, 2013

(54) CORONA DISCHARGER AND IMAGE FORMING APPARATUS

(75) Inventors: Hiroshi Saito, Toride (JP); Hiroshige Inoue, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 164 days.

(21) Appl. No.: 13/297,574

(22) Filed: Nov. 16, 2011

(65) Prior Publication Data

US 2012/0128390 A1 May 24, 2012

(30) Foreign Application Priority Data

Nov. 19, 2010 (JP) ..... 2010-259018

(51) Int. Cl.
*G03G 15/02* (2006.01)
*G03G 21/18* (2006.01)

(52) U.S. Cl.
USPC ..... 399/170; 399/115

(58) Field of Classification Search
USPC ..... 399/115, 170–172
See application file for complete search history.

(56) References Cited

U.S. PATENT DOCUMENTS 3,578,970 A * 5/1971 Michaud et al. ..... 399/169
4,746,796 A * 5/1988 Heigl ..... 250/324
5,337,131 A * 8/1994 Sagiv et al. ..... 399/170
6,108,504 A * 8/2000 Dickhoff ..... 399/170
7,149,448 B2 12/2006 Saito
2007/0248379 A1* 10/2007 Onuma et al. ..... 399/115
2012/0128389 A1* 5/2012 Saito ..... 399/170

FOREIGN PATENT DOCUMENTS

JP 6-124036 A 5/1994
JP 2004-029504 A 1/2004

* cited by examiner

*Primary Examiner* — G. M. Hyder

(74) *Attorney, Agent, or Firm* — Fitzpatrick, Cella, Harper & Scinto

(57) ABSTRACT

A corona discharger includes a shield and a charging wire provided in the shield, for generating corona discharge by applying a voltage to the charging wire. The corona discharger further includes a winding-up portion for winding up the charging wire by rotation thereof to move the charging wire in the shield, a driving portion for rotationally driving the winding-up portion, a rotation detecting portion for detecting the rotation of the winding-up portion, and a controller for controlling the driving portion so that a cumulative rotation amount of the winding-up portion is counted on the basis of a detection result of the rotation detecting portion and then a rotation amount of the winding-up portion per unit winding-up length of the charging wire is decreased with an increase of the cumulative rotation amount.

3 Claims, 22 Drawing Sheets

CORONA DISCHARGER AND IMAGE FORMING APPARATUS

FIELD OF THE INVENTION AND RELATED ART

The present invention relates to a corona discharger for generating corona discharge by applying a voltage to a charging wire and relates to an image forming apparatus using such a corona discharger.

An image forming apparatus in which a step of electrostatically transferring a toner image, electrostatically formed on a surface of an image bearing member, from the image bearing member onto a recording material such as paper is performed has been conventionally known. In such an image forming apparatus the surface of the image bearing member is uniformly charged, and an electrostatic latent image is formed on the charged surface and then is developed into the toner image with a toner. The toner image formed on the image bearing member is transferred onto the recording material under voltage application. The corona discharger is used as a charging means for charging such an image bearing member, a transfer means for transferring the toner image onto the recording material or a separating means for separating the recording material from the image bearing member.

The corona discharger generates the corona discharge by applying the voltage to the charging wire provided in a shield. The charging wire used in such a corona discharger is determined by deposition or erosion of an electric discharge product by the electric discharge for a long time, thus being less liable to cause the electric discharge. As a result, for example, in the case where the surface of the image bearing member is electrically charged, charging non-uniformity occurs. In order to prevent the occurrence of the charging non-uniformity, a corona charger (corona discharger) in which a plurality of wires of the charging wire are provided and thus a charging performance is improved has been devised. However, even in the case where such a plurality of wires of the charging wire are provided, when the corona charger is continuously used for a long time, with the result that the charging wire is deteriorated by the electric discharge and thus the charging non-uniformity occurs. Further, current leakage is liable to occur due to deposition of a contaminant such as the electric discharge product. In addition, in the case where the corona discharger is used as the transfer means or the separating means, there is a possibility of an occurrence of improper transfer or improper separation.

Therefore, in order to prevent the occurrence of such charging non-uniformity, a corona charger provided with a mechanism for feeding a fresh charging wire while performing winding-up of the deteriorated charging wire has been devised (Japanese Laid-Open Patent Application (JP-A) 2004-029504 and JP-A Hei 6-124036). In the case of structures described in JP-A 2004-029504 and JP-A Hei 6-124036, a single charging wire is turned back and used, thus being regarded as two charging wires. Then, by performing a winding-up operation, the charging performance is enhanced and the charging non-uniformity is less liable to occur.

As described above, in the case where the charging wire is wound up, the wire is successively superposed on a winding-up member (reel) for winding up the charging wire. For this reason, every (one) rotation of the reel, an apparent outer diameter of the reel is increased, so that a winding-up length of the charging wire wound up per (one) rotation of the reel is also increased. For this reason, irrespective of a winding-up amount of the charging wire, the apparent outer diameter of the reel is increased in the case where the wire winding-up operation is repeated by always rotating the reel with the same rotation amount, so that a winding-up amount is larger than that at an initial state. That is, a quantitative winding-up operation of the charging wire cannot be performed. As a result, in the case where the wire winding-up operation is repeated again and again, not only the used charging wire portion but also a fresh charging wire portion are collected, so that the whole area of the charging wire cannot be used, i.e., an unused portion occurs, so that the winding-up operation is not efficient.

SUMMARY OF THE INVENTION

A principal object of the present invention is to provide a corona discharger capable of reducing a degree of an increase of a winding-up amount of a charging wire more than necessary even when a winding-up of the charging wire is repeated.

Anther object of the present invention is to provide an image forming apparatus including the corona discharger.

These and other objects, features and advantages of the present invention will become more apparent upon a consideration of the following description of the preferred embodiments of the present invention taken in conjunction with the accompanying drawings.

Figure 16:
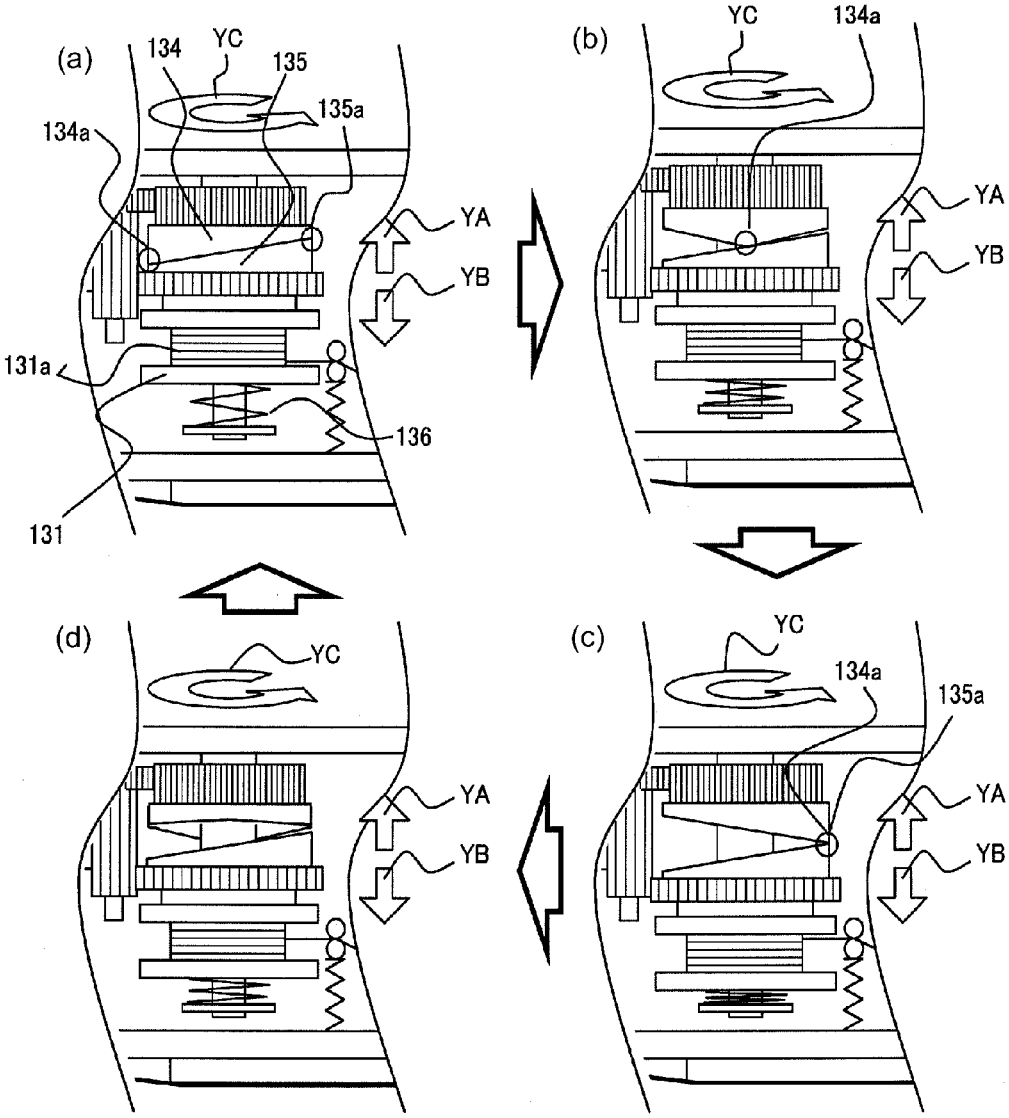

Parts (a) to (d) of FIG. 16 are schematic views for illustrating a series of operations for changing a position of a winding-up reel by the reel up-and-down motion unit.

Figure 17:
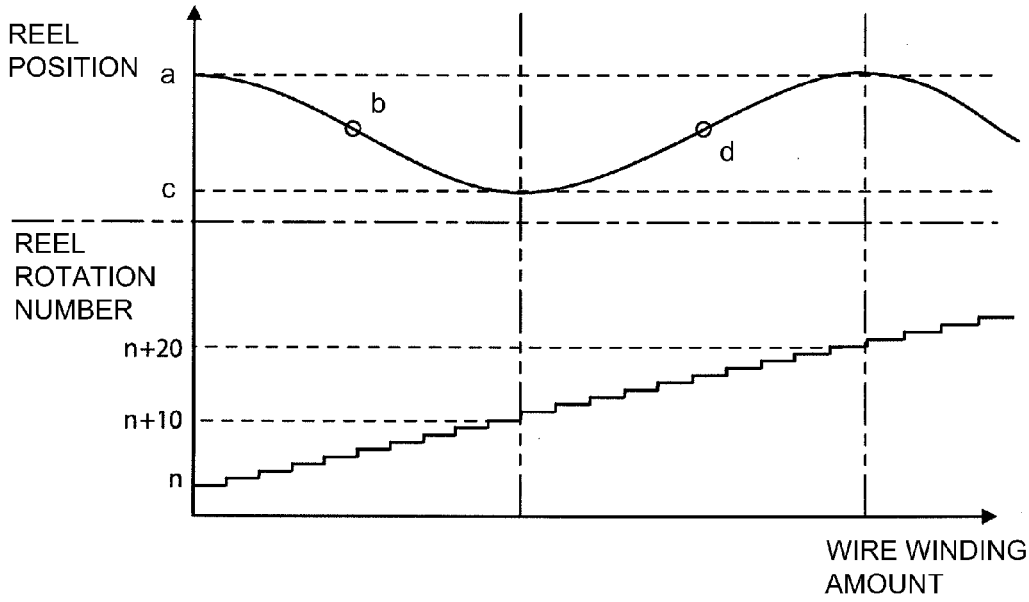

FIG. 17 is a graph showing a relationship between a winding-up amount of the wire and a position of the winding-up reel and between the wire winding-up amount and a rotation number of the reel.

Figure 18:
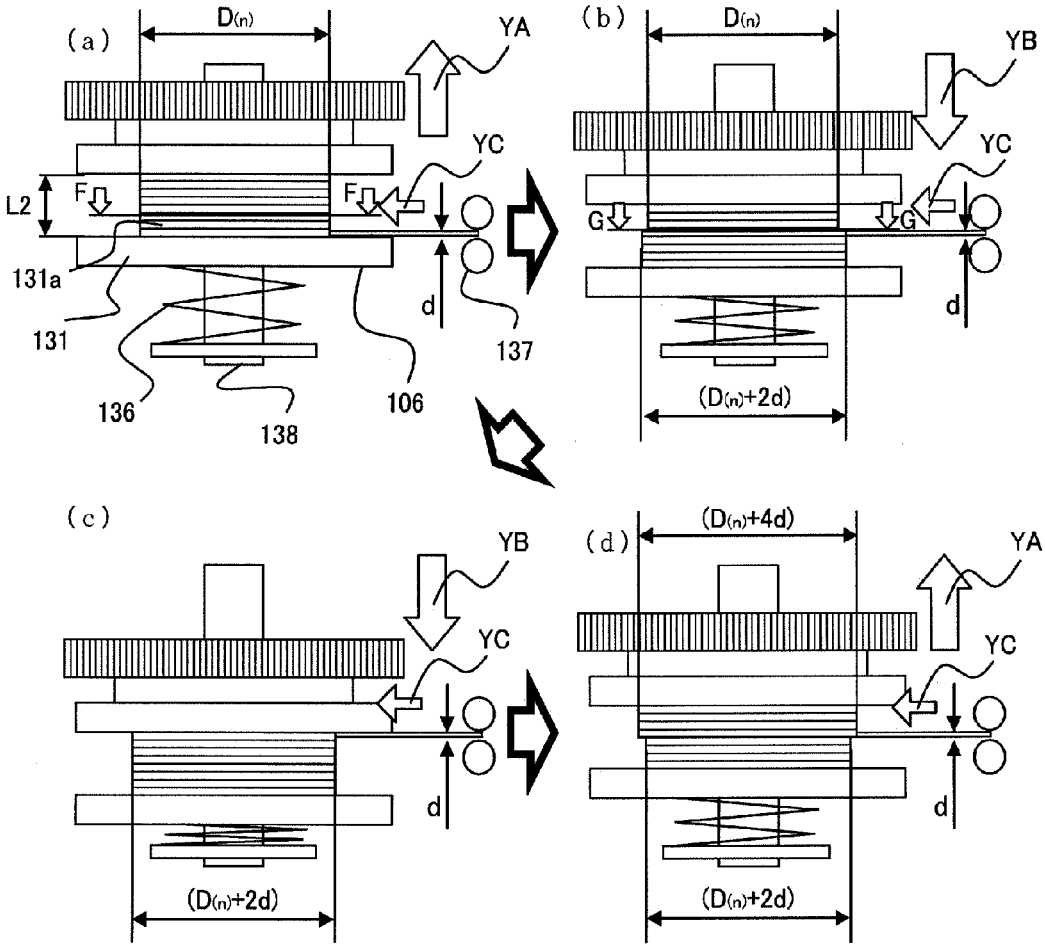

Parts (a) to (d) of FIG. 18 are schematic views for illustrating a series of operations for winding up the charging wire about the winding-up reel.

Figure 19:
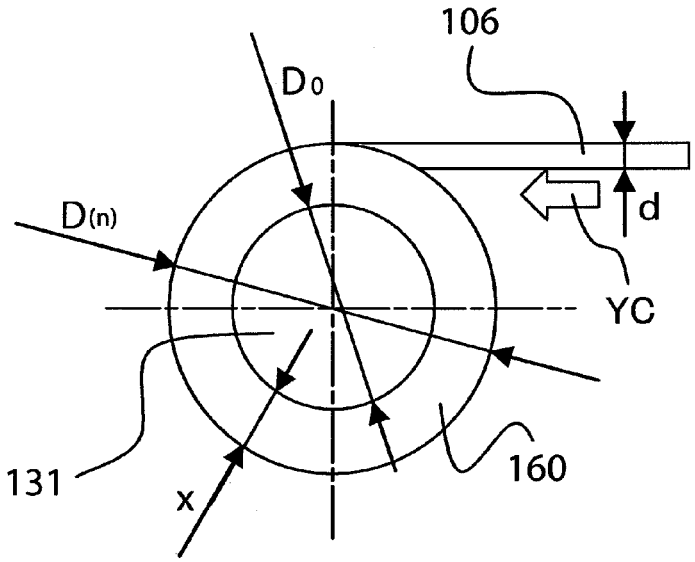

FIG. 19 is a sectional view of a reel portion taken along F-F line indicated in (a) of FIG. 18.

Figure 20:
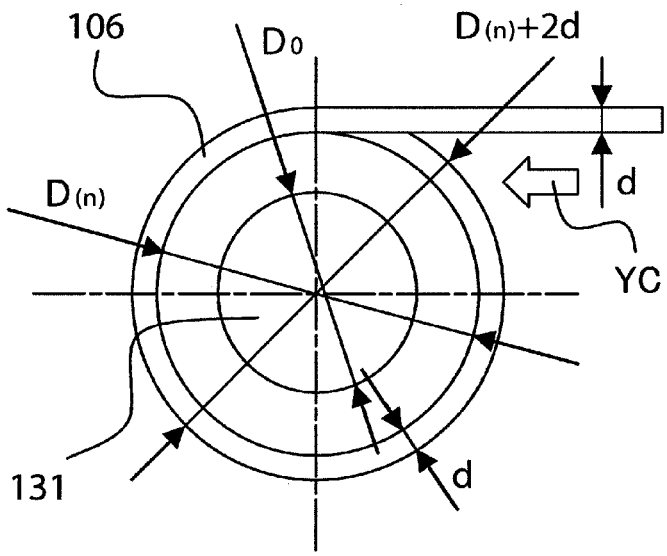

FIG. 20 is a sectional view of a reel portion taken along G-G line indicated in (b) of FIG. 18.

Figure 21:
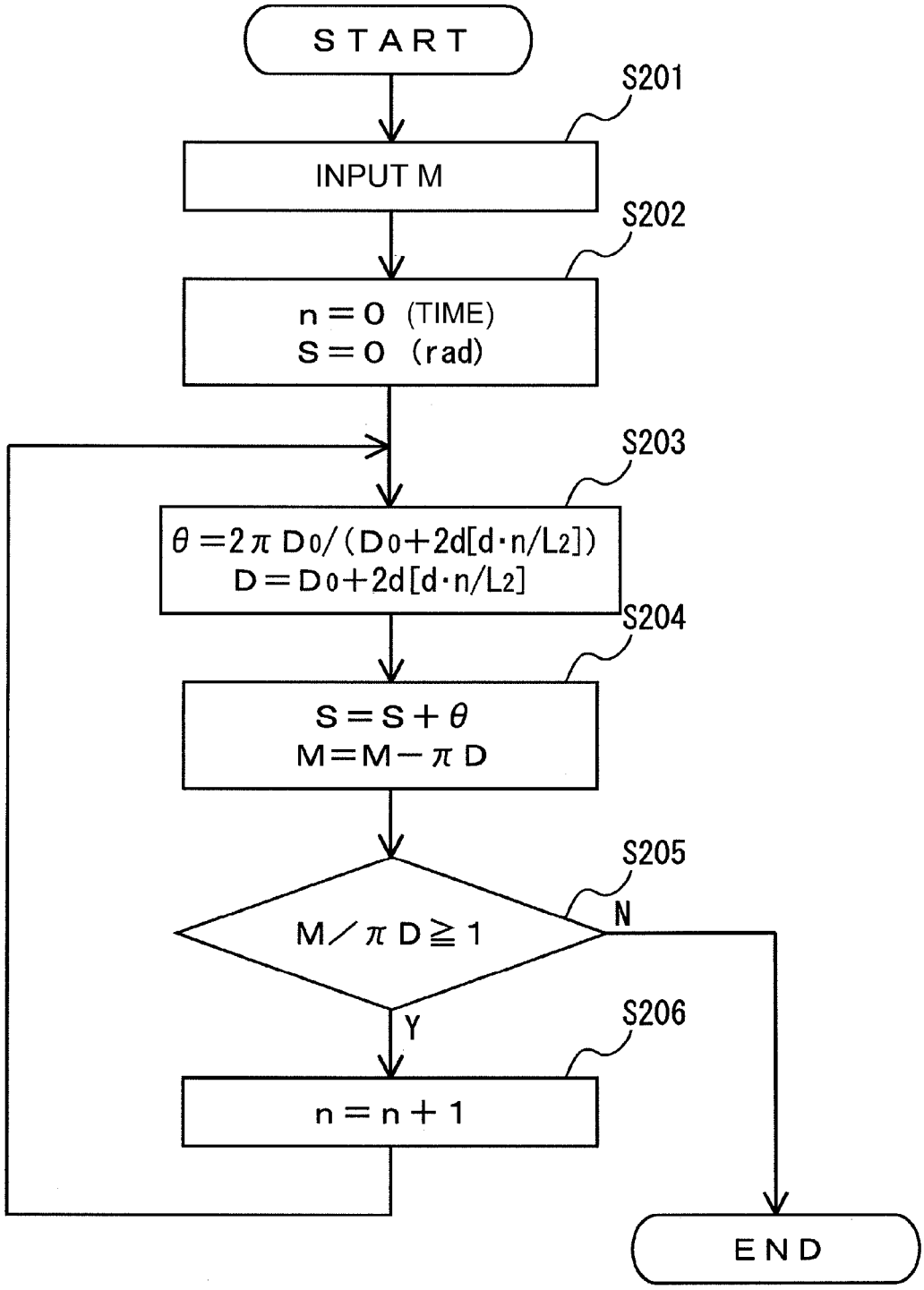

FIG. 21 is a flow chart for deriving a reel rotation amount S necessary to winding up the charging wire with a length M in Second Embodiment.

Figure 22:
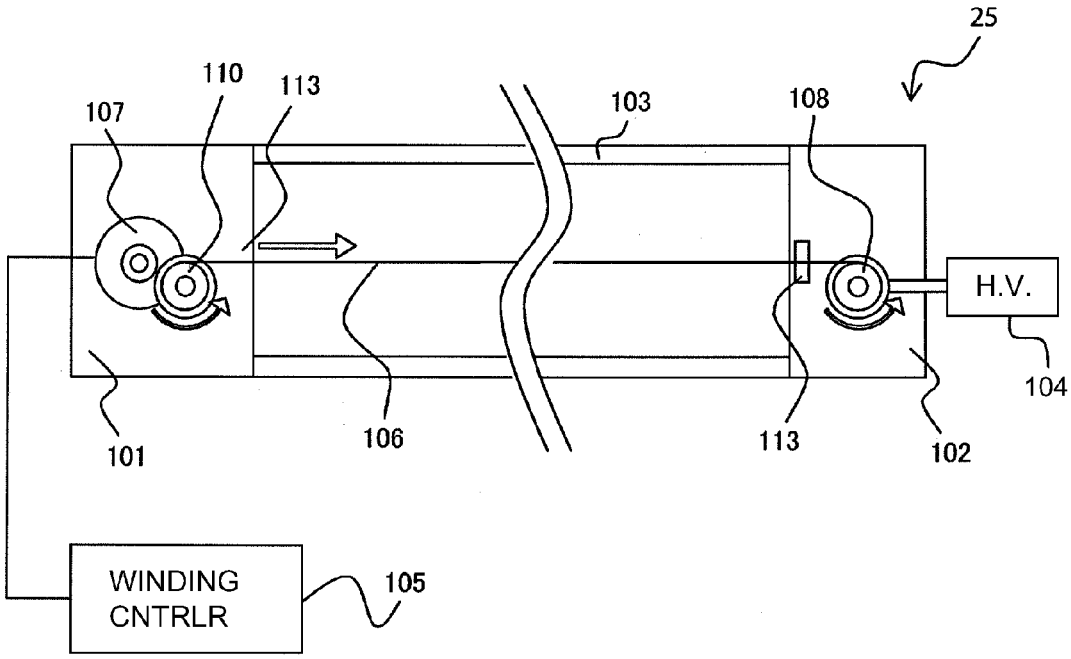

FIG. 22 is a schematic plan view of a primary charger in Third Embodiment.

DESCRIPTION OF THE PREFERRED EMBODIMENTS

First Embodiment

First Embodiment of the present invention will be described with reference to FIGS. 1 to 10. First, a general structure of an image forming apparatus to which the present invention is applied will be described with reference to FIG. 1.

[Image Forming Apparatus]

Figure 1:
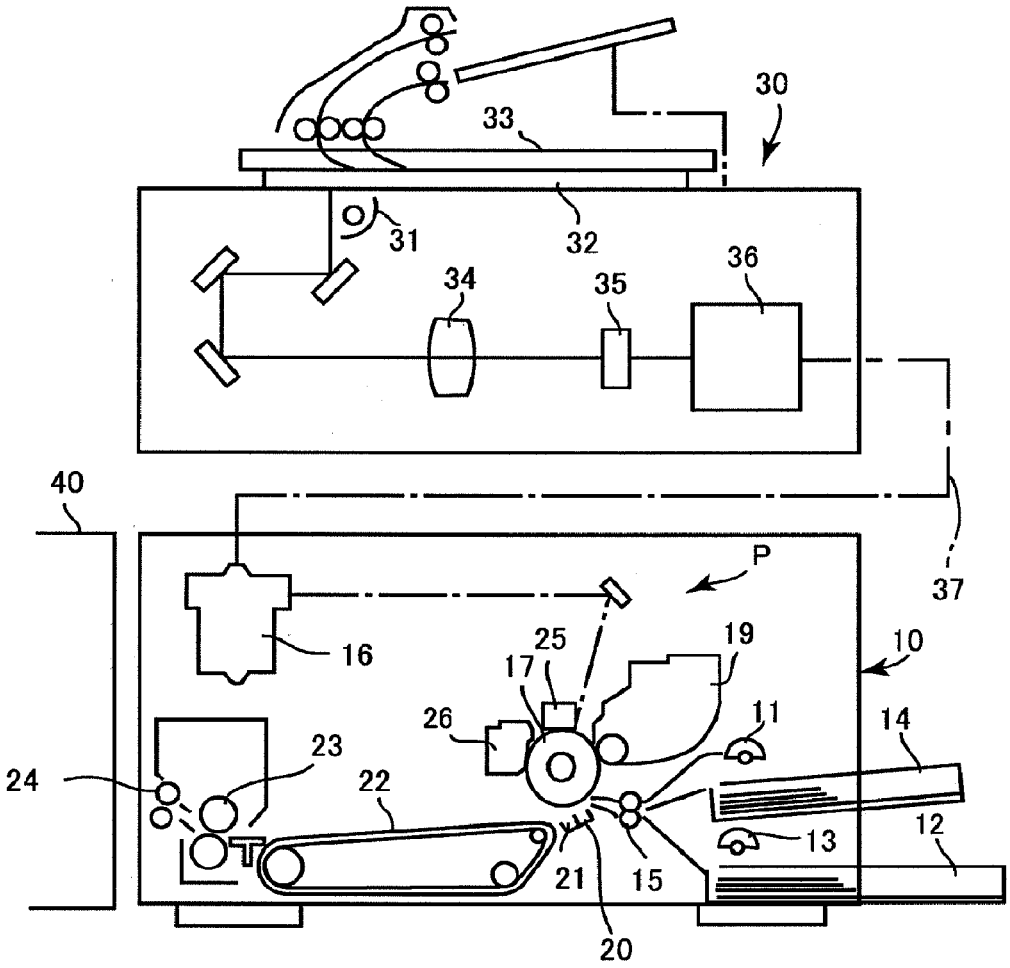
FIG. 1 is a schematic structural view of an image forming apparatus according to First Embodiment of the present invention.

As shown in FIG. 1, an image forming apparatus 10 includes an upper cassette 14 and lower cassette 12 for stacking sheets of a recording material on which an image is to be formed. The sheets in the upper cassette 14 are separated one by one by a separation claw (not shown) and a sheet feeding roller 11 to be fed to a registration roller 15. The sheets in the lower cassette 12 are separated one by one by a separation claw (not shown) and a sheet feeding roller 13 to be fed to the registration roller. Then, on the surface of the recording material fed to the registration roller, an image is formed by an image forming portion P.

The image forming portion P is constituted by a photosensitive drum 17, a primary charger 25, a laser scanner 16, a developing device 19, a transfer charger 20, a separation charger 21 and a cleaning member 26. The photosensitive drum 17 as an image bearing member is formed in a cylindrical shape and is rotationally driven. By the rotation, a toner image carrying surface is moved. The primary charger 25 as a charging means is constituted by a corona discharger (corona discharge device) disposed opposed to an outer peripheral surface of the photosensitive drum 17 and electrically charges the surface of the photosensitive drum 17 to a predetermined potential by corona discharge.

The laser scanner 16 as an exposure means (electrostatic latent image forming means) irradiates the surface of the photosensitive drum 17 charged by the primary charger 25 with laser modulated on the basis of an electric signal 37 (image data) described later, so that an electrostatic latent image is formed on the surface of the photosensitive drum 17. The developing device 19 as a developing means is disposed opposed to the surface of the photosensitive drum 17 to develop with a toner the electrostatic latent image formed on the surface of the photosensitive drum 17 into a toner image. The toner image carried on the photosensitive drum 17 is transferred at a transfer portion onto the recording material which is conveyed while being timed by the registration roller 15. At the transfer portion, the transfer charger 20 constituted by the corona discharger is disposed opposed to the photosensitive drum 17. By applying a predetermined transfer bias to the transfer charger 20, the toner image is transferred onto the recording material.

The recording material on which the toner image is transferred is separated from the photosensitive drum 17 by applying a predetermined separation bias to the separation charger constituted by the corona discharger, so that the recording material is conveyed to a fixing device 23 by a conveyer belt 22. The toner image is heat-fixed on the recording material by the fixing device 23. Thereafter, the recording material on which the toner image is fixed is discharged on a sorter 40.

Further, in FIG. 1, a scanner 30 as an original reading means includes a scanning optical system light source 31, a platen glass 32, an openable original pressing plate 33, a lens 34, a light-receiving element 35 as a photoelectric conversion element, and an image processing portion 36. An original image read by the scanning optical system light source 31 is processed by the image processing portion 36 and is converted into an electric signal 37 indicated by a chain line and then is set to the laser scanner 16 of the image forming portion P.

[Corona Discharger]

Next, the primary charger 25 as the corona discharger will be described more specifically with reference to FIGS. 2 to 6. The primary charger 25 is the corona charger of a non-contact type in which a grounded shield 103 and a charging wire (charge wire) 106 prepared by subjecting a tungsten wire to gold plating are provided. Then, corona discharge is generated by applying a high voltage to the charging wire 106, so that the surface of the photosensitive drum 17 is charged.

Figure 2:
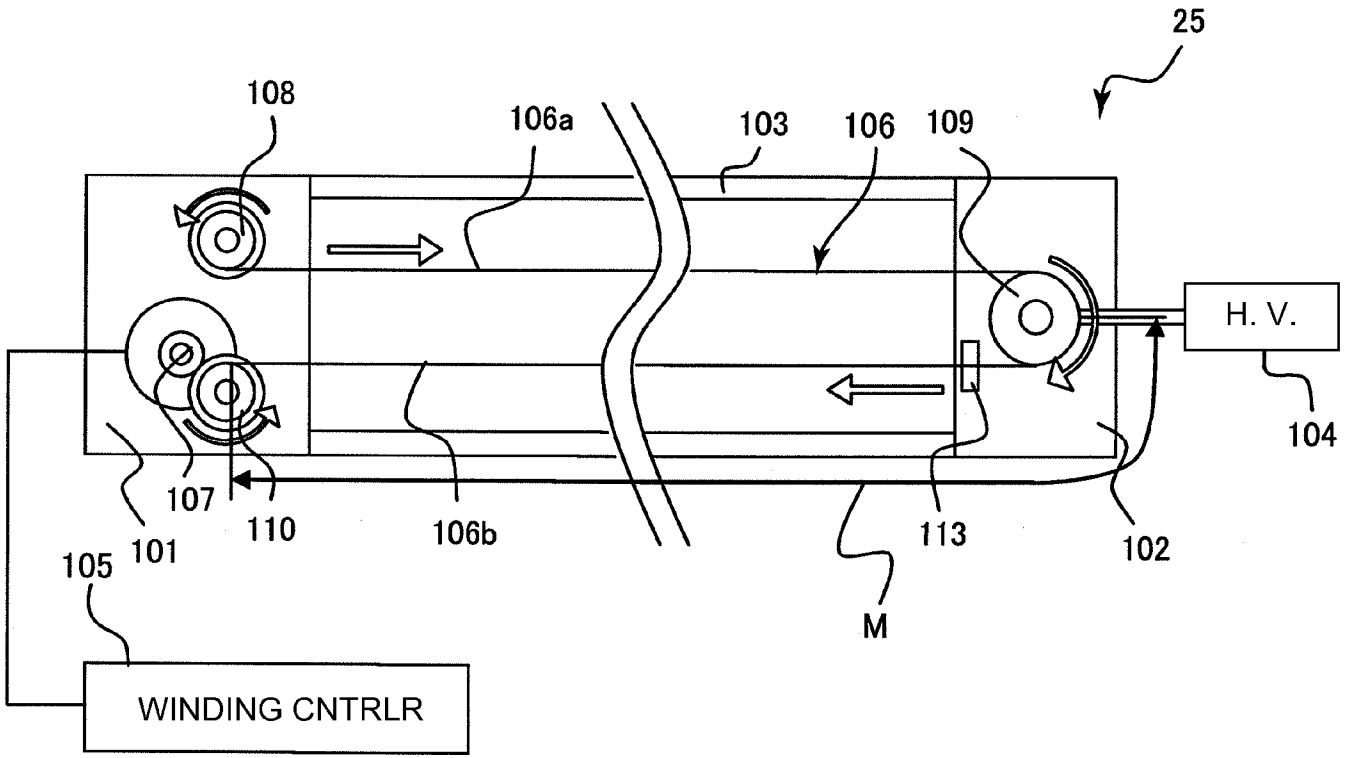
FIG. 2 is a schematic plan view showing a primary charger in First Embodiment.

The charging wire 106 is provided so as to be turned back at least at one position. In this embodiment, the charging wire 106 is turned back at one position as shown in FIG. 2, so that two wires (wire portions) 106*a* and 106*b* are disposed in the shield 103. The wires 106*a* and 106*b* are provided substantially parallel to a rotational axis direction (perpendicular to a surface movement direction) of the photosensitive drum 17 and are arranged side by side in a rotational direction of the photosensitive drum 17. The primary charger 25 is disposed so that the wire 106*a* is located at a downstream side and the wire 106*b* is located at an upstream side, with respect to the rotational direction of the photosensitive drum 17.

Further, the shield 103 is formed to cover both sides of the wires 106*a* and 106*b* with respect to the photosensitive drum rotational direction and to cover a side opposite from the photosensitive drum 17 side. Further, an area which is surrounded by the shield 103 and opposes the photosensitive drum 17 is a discharge area in which the corona discharge is generated. On the other hand, an area outside the shield 103 is a non-discharge area.

Figure 3:
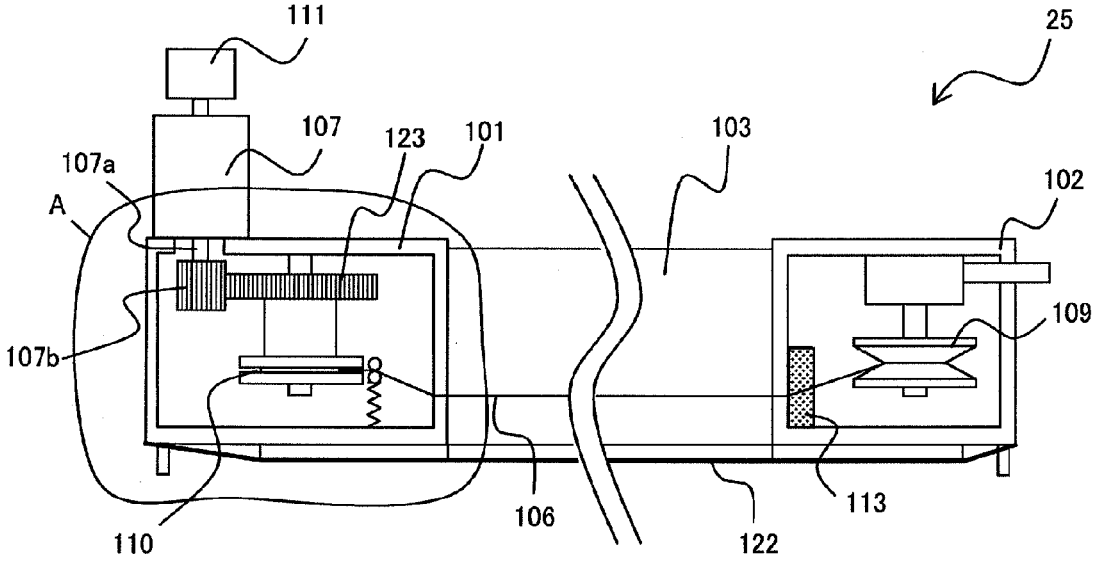
FIG. 3 is a schematic side view showing the primary charger in First Embodiment.
Figure 4:
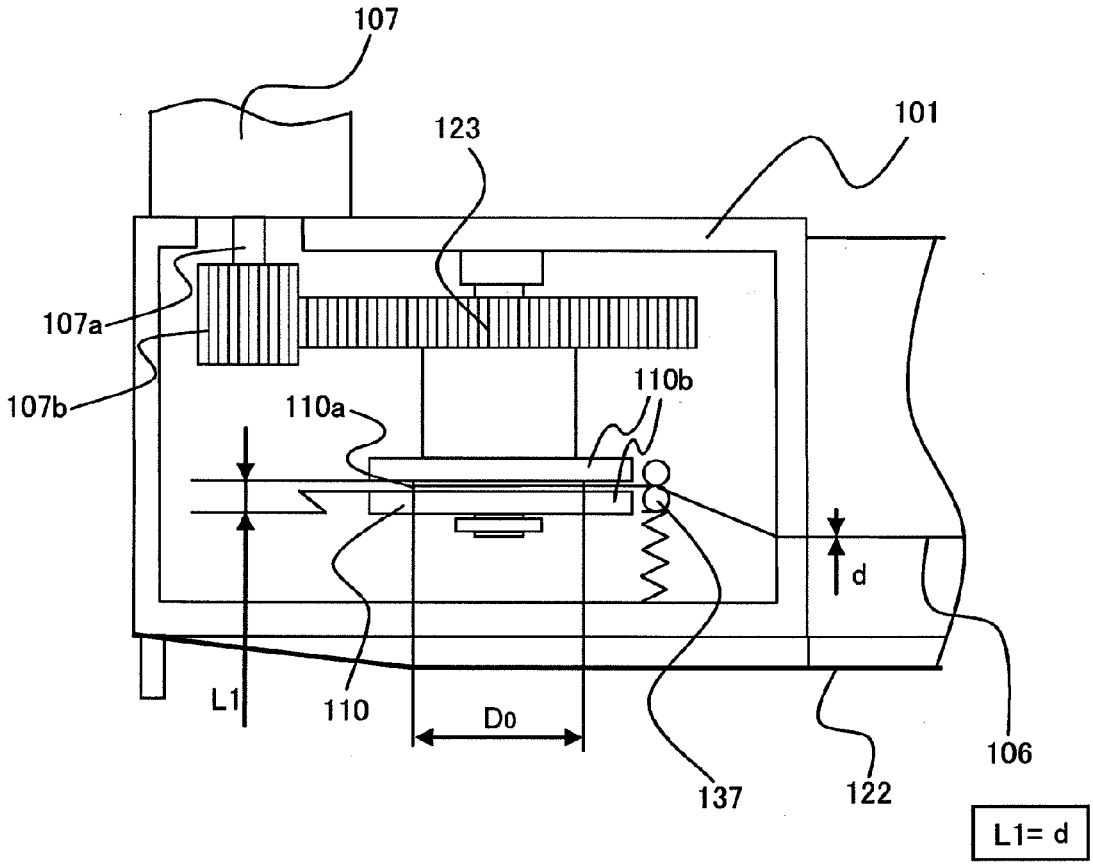
FIG. 4 is an enlarged view of a portion A indicated in FIG. 3.

Further, in this embodiment, the primary charger 25 is a charger of a scorotron type. That is, as shown in FIGS. 3 and 4, at a side closer to the photosensitive drum 17 than the charging wire 106, a plurality of grid wires 122 are provided in parallel to the wires 106*a* and 106*b*. Therefore, a charge potential of the surface of the photosensitive drum can be variably changed by a voltage applied to the grid wires 122.

Further, as shown in FIGS. 2 and 3, at both sides of the shield in which the wires 106*a* and 106*b* extend, a drive-side case 101 and an electrode-side case 102 are provided. In the drive-side case 101 provided at one end of the shield 103, a feeding reel 108 as a feeding means and a winding-up reel 110 as a winding-up means are provided. On the other hand, in the electrode-side core 102 provided at the other end of the shield 103, an electrode reel 109 and a cleaning member 113 are provided. Further, the drive-side case 101 is provided with a winding-up motor for rotationally driving the winding-up reel 110.

The winding-up reel 110 in the drive-side case 101 is connected to a winding-up reel gear 123 as shown in FIGS. 2 to 4. Further, a driving force is transmitted from a motor gear 107*b*, connected to a rotation shaft 107*a* of the winding-up motor 107, to the winding-up reel gear 123, so that the winding-up reel 110 connected to the winding-up reel gear 123 is rotated to perform the winding-up of the charging wire 106. Further, the rotation of the rotation shaft 107*a* of the winding-up motor 107 is detected by a rotation sensor 111 as a rotation detecting means.

This rotation sensor 111 includes a photo-interrupter and a disk (encoder) which is fixed to the rotation shaft 107*a* and which is provided with slits at a plurality of positions of the disk with respect to a circumferential direction. The rotation sensor 111 detects a rotation amount such as a rotational angle, a rotation number (rotational frequency) or the like of the rotation shaft 107*a*. When the rotation amount of the rotation shaft 107*a* can be detected, from the number of teeth of the gears 107*a* and 123, it is possible to detect the rotation amount of the winding-up reel 110. A signal detected by the rotation sensor is sent to a winding-up controller 105 described later. Incidentally, such a rotation detecting means may also be provided on the rotation shaft of the winding-up reel 110.

Further, the winding-up reel 110 is provided with a reel winding-up groove (winding-up portion) 110*a* having a width (winding-up reel width) L1 which is substantially equal to a wired diameter d of the charging wire 106 as shown in FIG. 4. Further, an outer diameter of each of flanges 110*b* and 110*b* sandwiching the groove 110*a* is sufficiently larger than an outer diameter $D_0$ of the bottom of the groove 110*a*, so that the charging wire 106 can be disposed between the flanges 110*b* and 110*b* so as to be superposed (wound) in a radial direction.

Further, upstream of the winding-up reel 110 with respect to the winding-up direction, a wire supporting member 137 for guiding the wire into the groove 110*a* is disposed. The wire supporting member 137 is urged in a rotational axis direction of the winding-up reel 110 to be shifted in the rotational axis direction of the groove 110*a* and the winding-up reel 110, so that the wire 106 entering the drive-side case 101 is guided into the groove 110*a*.

Figure 5:
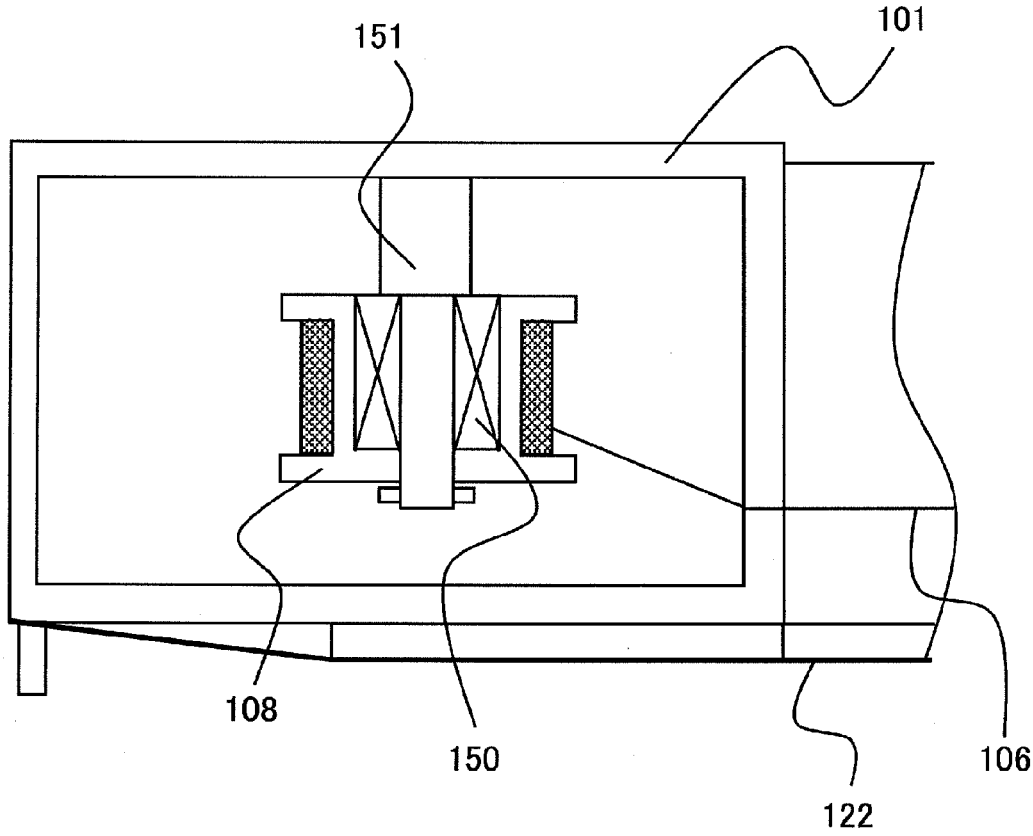
FIG. 5 is an enlarged sectional view of a feeding reel.

Further, about the feeding reel 108, the charging wire 106 is wound plural times and is fed successively by the feeding reel 108 depending on a winding-up amount of the winding-up reel 110. Incidentally, as an initial state, a fresh charging wire 106 is wound about the feeding reel 108 in an amount which is not less than an amount required until the primary charger 25 reaches the end of its lifetime. Further, as shown in FIG. 5, in the feeding reel 108, a torque limiter 150 is incorporated and applies a predetermined tension to the charging wire 106 when the charging wire 106 is wound up by the winding-up reel 108, thus preventing the charging wire 106 from loosening. Incidentally, as the torque limiter, it is possible to employ a general constitution such as a constitution using a brake, a constitution in which a winding-up shaft 151 and the feeding reel 108 provide a transition fit to obtain a sliding resistance, or the like constitution.

Further, as shown in FIGS. 2 and 3, in the electrode-side case 102, the electrode reel 109 is connected to a high-voltage source 104 and the charging wire is extended and wound around the electrode reel 109. Further, a high voltage can be applied from the high-voltage source 104 to the charging wire 106, and the charging wire 106 is turned back in the electrode-side case 102.

In this embodiment, a moving means for moving the charging wire 106 is constituted by the feeding reel 108, the winding-up reel 110, the driving motor 107 and the winding-up controller 105 (described later with reference to FIG. 6). That is, the charging wire 106 is wound up by driving the driving motor 107 to rotate the winding-up reel 110. Further, depending on a degree of the winding-up, the charging wire 106 is fed from the feeding reel 108. As a result, the charging wire 106 is moved in a direction indicated by arrows in FIG. 2, via the electrode reel 109. The winding-up motor 107 is controlled by the winding-up controller 105 and a rotation amount thereof can be accurately controlled on the basis of a detection result of the above-described rotation sensor 111.

Figure 6:
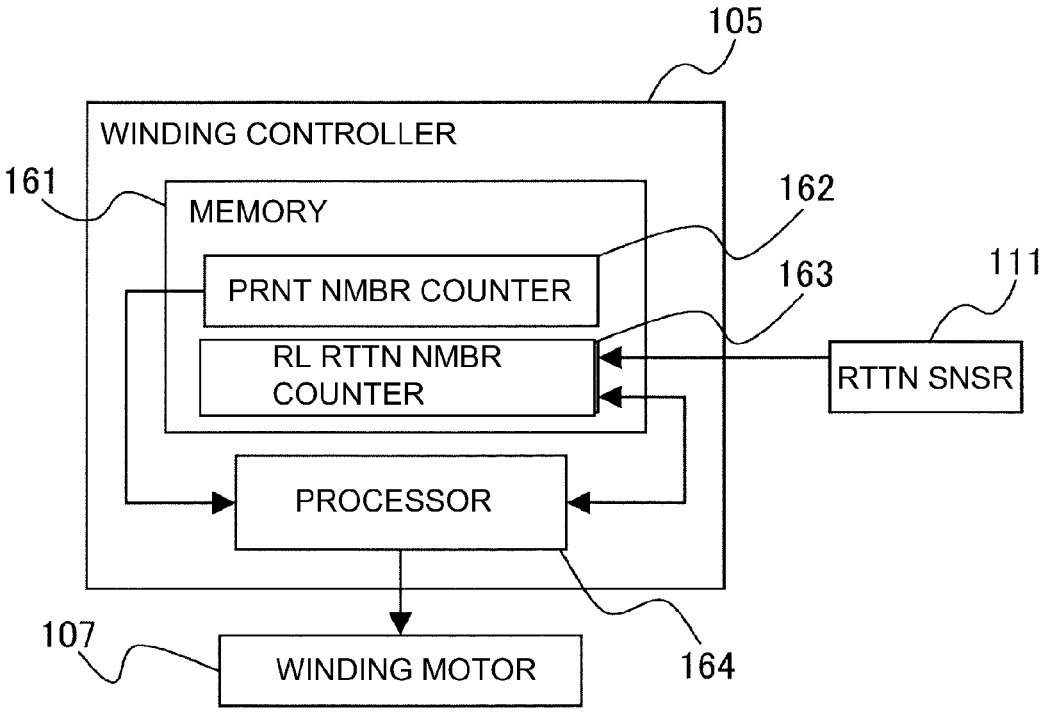
FIG. 6 is a block diagram of a winding-up controller.

The winding-up controller 105 includes, as shown in FIG. 6, a memory 161 and a processing portion 164. The memory 161 includes a print number counter 162 for cumulatively adding (counting) the print number and a reel rotation number counter 163 for cumulatively adding the reel rotation number. The reel rotation number counter 163 obtains a rotation amount of the winding-up reel 110 by converting the rotation amount (a detection result of the rotation sensor 111) of the winding-up motor 107. Rotation timing and the rotation amount of the winding-up motor 107 are processed by calculating values stored in the memory 161 by the processing portion 164.

The winding-up controller 105 controls the winding-up motor 107 to move the charging wire 106, e.g., in the following manner. That is, the wire fed from the feeding reel 108 is moved to a photosensitive drum rotational direction downstream position of a discharging area. The wire 106*a* provided at the photosensitive drum rotation direction downstream position of the discharging area is moved to a photosensitive drum rotational direction upstream position of the discharging area is wound up by the winding-up reel 110 in the driving-side case 101. Incidentally, such a constitution that the charging wire 106*a* located at the photosensitive drum rotational direction downstream position is wound up depending on a device characteristic and a fresh charging wire 106*b* is supplied to the photosensitive drum rotational direction upstream position may also be employed. Further, in order to obtain a more stable charging performance, it is also possible to employ a constitution in which the whole area of the used charging wires 106*a* and 106*b* is wound up.

By employing the above constitution, when the surface of the photosensitive drum 17 is charged, the single charging wire 106 can used as two charging wires consisting of the photosensitive drum rotational direction upstream wire 106*a* and the photosensitive drum rotational direction downstream wire 106*b*. As a result, the charging performance is improved, so that the charging non-uniformity is less liable to occur.

Further, as shown in FIGS. 2 and 3, the cleaning member 113 is provided in the electrode-side case 102. The cleaning member 113 is disposed downstream of the electrode reel 109 with respect to a wire movement direction. The cleaning member 113 slides with the charging wire 106 when the charging wire 106 is wound up and moved by the winding-up reel, thus removing a contaminant such as a discharge product deposited on the charging wire 106. That is, the cleaning member 113 provided in the electrode-side case 102 cleans the wire 106*a* provided in the discharging area. The wire 106*a* is then used as the wire 106*b* and therefore is cleaned by the cleaning member in such a manner, so that deterioration of the wire due to the electric discharge can be delayed at an initial stage.

Figure 7:
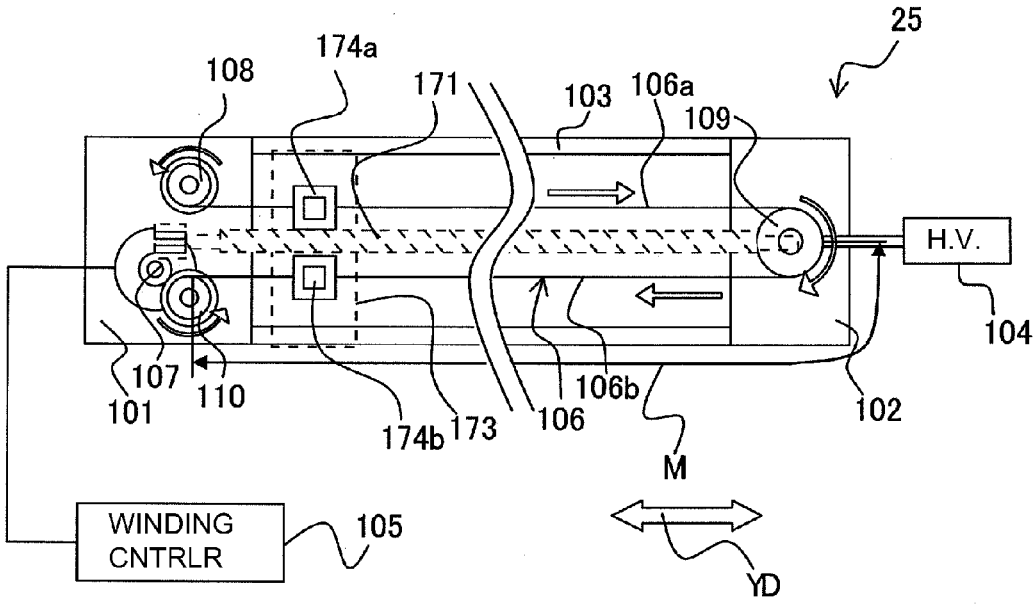
FIG. 7 is a schematic plan view showing a structure of another primary charger capable of moving a cleaning member.
Figure 8:
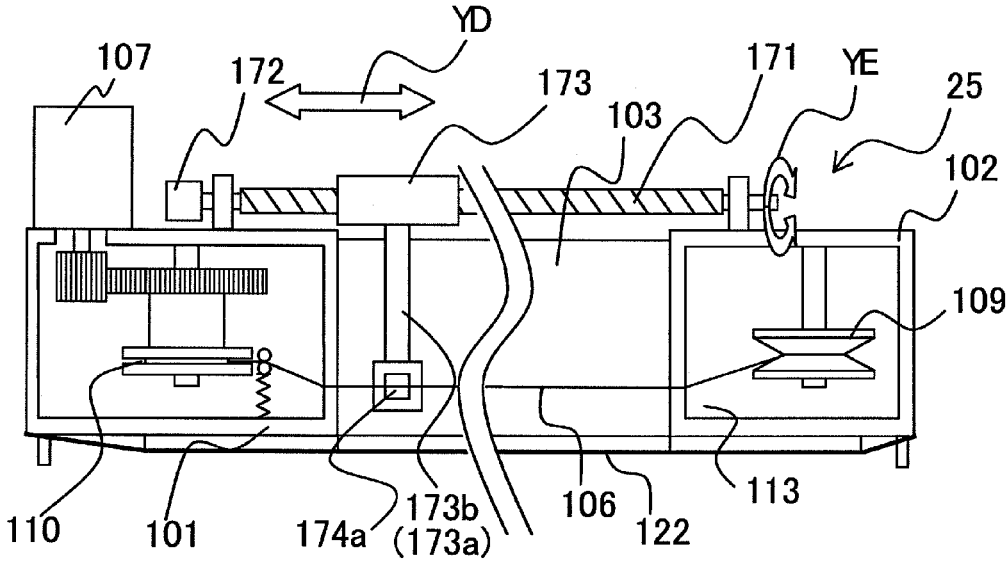
FIG. 8 is a schematic plan view showing the structure of another primary charger.

Incidentally, the cleaning member 113 for cleaning the charging wire 106 may also have a constitution as shown in FIGS. 7 and 8. That is, cleaning members 174*a* and 174*b* may be moved to clean the wire 106. The constitution shown in FIGS. 7 and 8 will be described below. A screw 171 is held between the driving-side case 101 and the electrode-side case 102 in parallel to the wires 106*a* and 106*b*. Further, the screw 171 obtains the driving force from an unshown driving source, capable of being rotated forward and reversely, via a screw gear 172 to rotate forward and reversely (in an arrow YE direction). Further, with the screw 171, a cleaning member holding member 171 is engaged and thus is operable in an arrow YD direction along a screw groove of the screw 171. Further, the cleaning member holding member 173 includes arm portions 173*a* and 173*b* to which the cleaning members 174*a* and 174*b* are mounted, respectively. For that reason, by the forward and reverse rotation of the unshown driving source, the cleaning members 174*a* and 174*b* are moved in the arrow YD direction, so that the wires 106*a* and 106*b* can be cleaned.

[Control of Charging Wire Winding-Up Amount]

Figure 9:
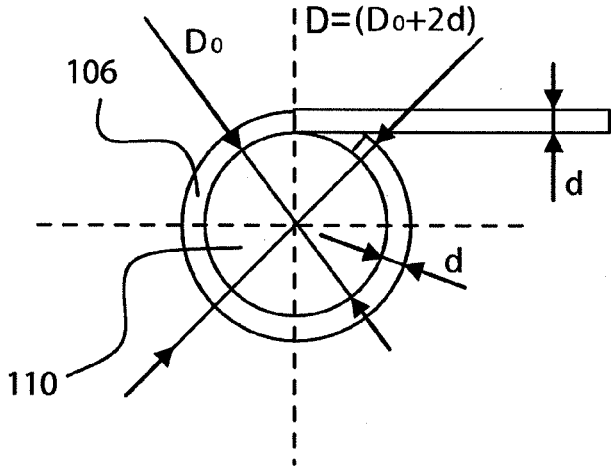
FIG. 9 is a schematic view showing a state in which a charging wire is wound up by a winding-up reel.

As shown in FIG. 9, the winding-up amount of the charging wire 106 depends on a winding-up reel diameter D of the winding-up reel 110. Here, by repeating a winding-up operation, as shown in FIG. 9, the used charging wire 106 is wound up by the winding-up reel 110 and therefore an apparent winding-up reel diameter D is gradually increased. As shown in FIG. 9, the apparent reel diameter per (one) rotation of the winding-up reel 110 is increased with an increment of 2d (d: wire diameter) with respect to another diameter $D_0$ of the bottom of the groove 110*a*, so that an apparent circumferential length is also increased with an increment of $2\pi d$.

Figure 10:
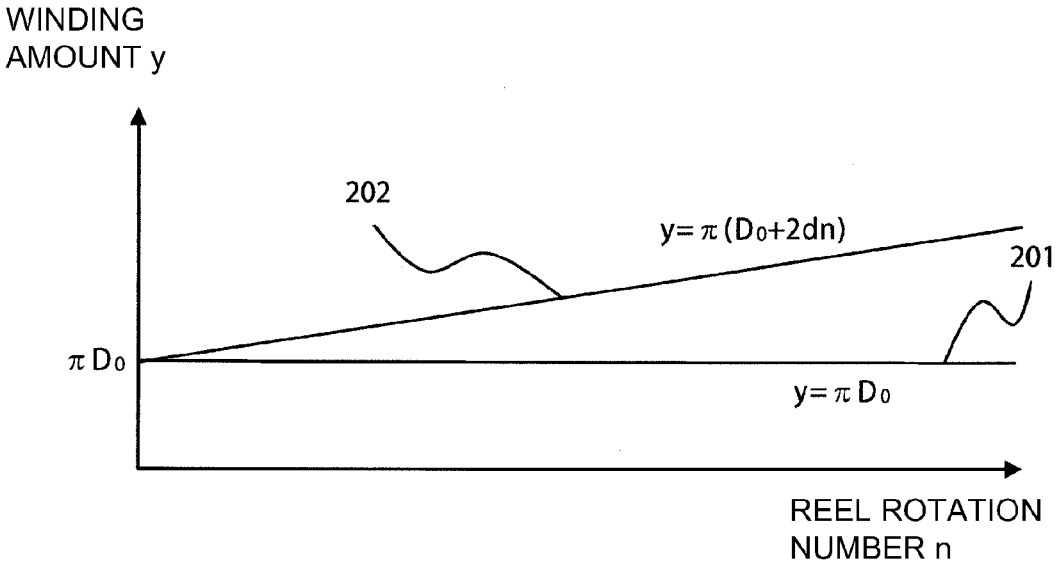
FIG. 10 is a graph showing a relationship between a winding-up amount of the wire and a rotation number of the winding-up reel.

FIG. 10 is a graph showing a relationship between the reel rotation number and the wire winding-up amount. A line 201 shows the case where the winding-up reel diameter is not changed from that at the initial stage, so that the winding-up can be always performed with a winding-up amount of $\pi D_0$. However, actually, as described above, the reel diameter is increased by the winding-up of the wire, so that the winding-up amount per rotation is increased every winding-up operation number as indicated by a line 202.

For this reason, in this embodiment, in order to suppress the increase of the winding-up amount, the rotation amount of the winding-up reel 110 driven by the winding-up motor 107 is controlled. That is, a cumulative rotation amount of the winding-up reel 110 is counted based on a detection result of the rotation sensor 111 and then the winding-up motor 107 is controlled so that the rotation amount of the reel 110 per unit winding-up length of the wire 106 is decreased with an increase of the number of laminations of the wire 106 with respect to a radial direction. Here, the lamination number with respect to the radial direction can be obtained from the cumulative rotation amount of the reel 110. Further, the unit winding-up length is a predetermined length of the wire 106. For example, a length of the wire 106 wound up in the case where the reel 110 is rotated one rotation (one full turn) from the initial state in which the wire 106 is not wound up by the reel 110 is taken as the unit winding-up length. In this case, in the initial state, the rotation amount of the winding-up reel 110 per unit winding-up length is $2\pi$ (one rotation) and is decreased, every increase of the winding-up number, correspondingly to the diameter of the wire 106.

Such control is effected by using a proper reel rotation angle θ at a cumulative (predetermined) rotation number n of the reel 110. Here, on the basis of the case where the reel diameter at the initial state in which the wire 106 is not wound up about the reel 110 is $D_0$ and the reel 110 is rotated one rotation ($2\pi$) at the initial reel diameter $D_0$, the rotational angle θ at the predetermined rotation number n of the reel 110 is obtained. That is, when the reel 110 is rotated at θ satisfying a ratio of $2\pi:D_0=\theta:(D_0+2d\times n)$, the winding-up amount of the wire 106 is always constant (irrespective of the cumulative rotation number). Therefore, θ is obtained by the following equation (1). Incidentally, a portion in parenthesis ([ ]) means that the numerical value is an integer obtained by dropping the functional portion of the numerical value.

$$\theta=2\pi D_0/(D_0+2d\times[n])[\text{rad}] \quad (1),$$

wherein θ represents the proper reel rotation angle, $D_0$ represents the initial reel diameter, d represents the diameter of the charging wire 106 and n represents the cumulative winding-up number.

Figure 11:
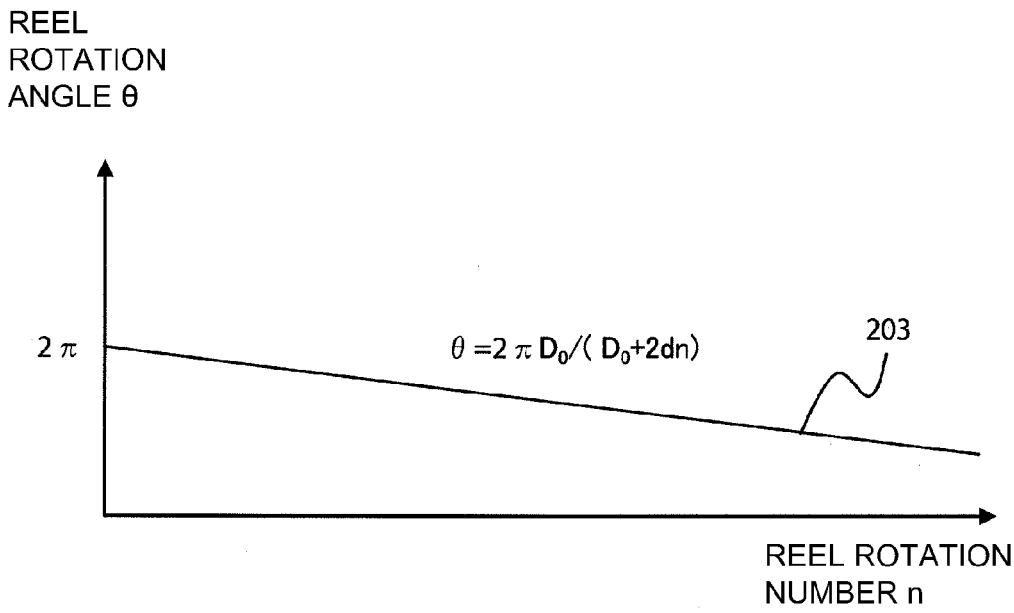
FIG. 11 is a graph showing a relationship between a rotational angle of the reel and the rotation number of the reel when control in First Embodiment is effected.

From the equation (1), it is understood that the rotation angle (rotation amount) of the reel 110 is decreased with the increase of the cumulative rotation number n of the reel 110. A graph showing a relationship between the proper reel rotation angle θ and the cumulative winding-up number (cumulative rotation number or the lamination number of the wire 106 with respect to the radial direction) is shown in FIG. 11. By effecting the control using such an equation (1), the rotation amount of the winding-up reel 110 per unit winding-up length of the charging wire 106 is decreased with the increase of the cumulative rotation amount of the reel 110, so that the winding-up amount of the wire 106 can be always a constant amount.

[Charging Wire Winding-Up Operation]

The operation of the charging wire 106 during exchange will be described. As described above, by rotating the winding-up motor 107 in a predetermined amount, the winding-up reel 110 is rotated in the winding-up direction as shown in FIG. 2, so that the charging wire 106 is wound up about the winding-up reel 110. Further, the feeding reel 108 is rotated by the tension of the charging wire 106 to feed a fresh charging wire 106.

By effecting such rotational control of the winding-up motor 107 in the following manner by the winding-up controller 105 during the deterioration due to the electric discharge of the charging wire 106 for a long time, an exchange process of the charging wire is performed.

The winding-up control is effected in an interruption manner during the print job. However, in order to reduce a printing time, the winding-up control may also be effected after the job without being effected during the job. In this embodiment, with reference to FIG. 6, the case where the winding-up control of the wire is effected by interrupting the printing job will be described. When the printing operation is started by the image forming apparatus 10, the print image number, i.e., the print number of sheets is cumulatively added (counted) by the print number counter 162 of the winding-up controller 105 and is stored. When the processing portion 164 judges that the print number reaches a predetermined value (the print number in which the winding-up operation is performed), the operation enters a charging wire exchanging mode. In the operation in the exchanging mode, by rotating the winding-up motor 107, a portion of the charging wire 106 used as the photosensitive drum rotational direction upstream wire 106*b* is wound up by the winding-up reel 110. At this time, simultaneously, a portion of the charging wire 106 used as the photosensitive drum rotational direction downstream wire 106*a* is disposed at the position in which the upstream wire 106*b* was located. Further, by feeding a fresh portion of the charging wire 106 by the feeding reel 108, the fresh portion of the charging wire 106 is disposed at the position in which the downstream wire 106*a* was located.

Incidentally, as a condition of transition to the operation in the exchanging mode, different from the print image number, it is also possible to use an elapsed time in the case where an electric discharging time of the primary charger 25 is cumulatively added and reaches a predetermined time. In addition, the operation may also enter the exchanging mode in the case where a voltage applied to the charging wire 106 is measured and reaches a predetermined value or the case where a potential of the photosensitive drum surface is measured by a surface electrometer and reaches a value not more than a predetermined potential.

Figure 12:
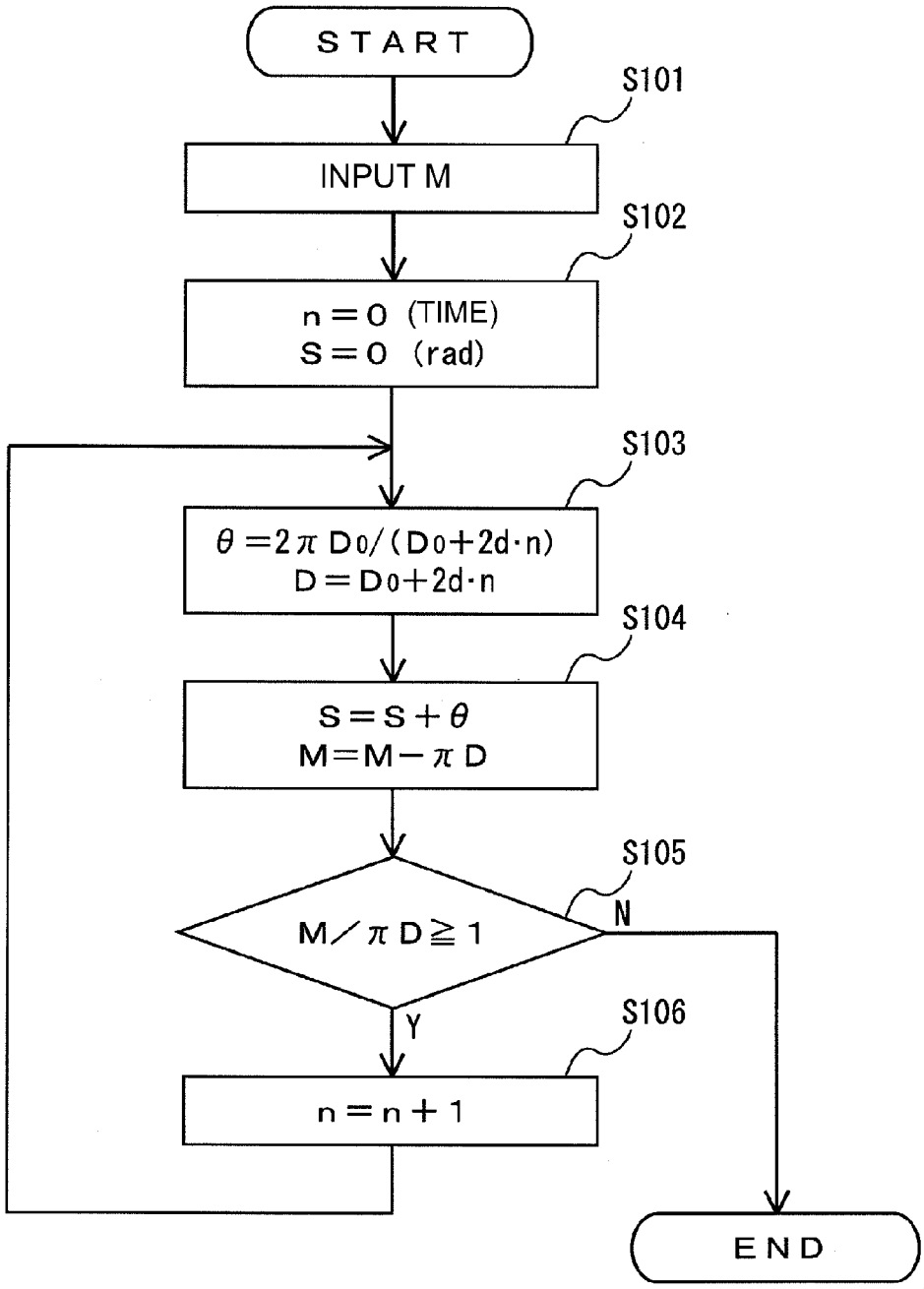
FIG. 12 is a flow chart for deriving a reel rotation amount S necessary to winding up the charging wire with a length M in First Embodiment.

FIG. 12 is an example of a flow chart for determining a rotation amount s of the winding-up reel 110 necessary to wind up the charging wire 106 in an intended winding-up amount M (e.g., a length of the charging wire 106 present in the range shown in FIG. 2) by the reel winding-up control in this embodiment. By rotating the winding-up reel 110 by the cumulative reel rotation amount s at the time until the operation reaches "END", it is possible to wind up the wire in the intended winding-up amount M or an amount close to the winding-up amount M. Incidentally, the winding-up amount M may also be, as described above, the whole length of the used charging wires 106*a* and 106*b*.

In the initial state, when the winding-up amount M is inputted into the winding-up controller 105 (S101), the cumulative rotation number n of the reel 110 and the rotation amount s of the reel 110 for winding up the wire in the winding-up amount M are reset in S102. Here, the initial state corresponds to, e.g., during product shipment, during exchange of the primary charger 25, and the like. Then, in S103, from the rotation number n (times) of the reel 110, the proper reel rotation angle θ and the apparent outer diameter $D_0$ of the reel 110 are obtained. Then, in S104, the rotation amount s (rad) of the reel 110 is accumulated to calculate a remaining winding-up amount M. In S105, whether or not the reel 110 is rotated one rotation or more in the remaining winding-up amount M is judged. In the case where the reel 110 is rotated one rotation or more, the rotation number n of the reel 110 is increased by 1 in S106, the operation is returned to S103. On the other hand, when the rotation number of the reel is less than 1 in S105 and in other words, in the case where the remaining winding-up amount M is less than the winding-up amount when the reel 110 is rotated one rotation, the calculation is ended and the rotation amount s at that time is the rotation amount s to be obtained.

In the case where the winding-up operation of the wire is performed in a subsequent operation or later, the previous rotation amount s is reset and the operation starts S103 and the rotation amount s with respect to the winding-up amount M at that time is obtained. Incidentally, the rotation number n is accumulated on the basis of the previous numerical value (i.e., n is not reset).

Here, the reason why the calculation is ended in the case where the remaining winding-up amount M is less than the winding-up amount when the reel 110 is rotated one rotation is as follows. The diameter of the reel 110 is generally small and when the small diameter of the wire 106 is taken into consideration, the apparent diameter of the reel 110 at that time is also small. Therefore, the winding-up amount corresponding to one rotation of the reel 110 at that time is small and thus the remaining winding-up amount M smaller than the winding-up amount corresponding to one rotation of the reel 110 means that the remaining winding-up amount M is considerably small. Further, a part of the wire 106 is also disposed in the driving-side case 101 and the electrode-side case 102 which are undischarged areas, and do not influence on the electric discharge. For this reason, even when the wire is not wound up in a considerably small amount, the amount is absorbed in the undischarged area or is very small even when the part of the wire 106 enters the discharging area, so that the part of the wire 106 does not influence on the electric discharge. Therefore, in this embodiment, the calculation is ended at that time and then the rotation amount s is obtained.

Incidentally, when the length of the reel present in the undischarged area is constituted so as to be not less than the winding-up amount corresponding to one rotation of the reel during a maximum winding-up state of the wire by the reel 110 (when the wire 106 is wound up until its end), the part of the wire 106 in the remaining winding-up amount M enters the discharging area. Further, in the case where the remaining winding-up amount M is less than the winding-up amount when the reel 110 is rotated one rotation, the calculation is not ended and then the rotation angle of the reel corresponding to the remaining winding-up amount M is obtained and may also be added to the rotation amount s.

Thus, by effecting the exchanging process of the charging wire 106, the charging wire 106 can always be wound up in a stable winding-up amount. For that reason, the whole area or the almost whole area of the charging wire 106 can be used, so that the operation is very economical.

Second Embodiment

Second Embodiment of the present invention will be described with reference to FIGS. 13 to 21. Hereinbelow, a constitution different from that in First Embodiment will be principally described and description of a constitution similar to that of First Embodiment will be omitted or simplified.

Figure 13:
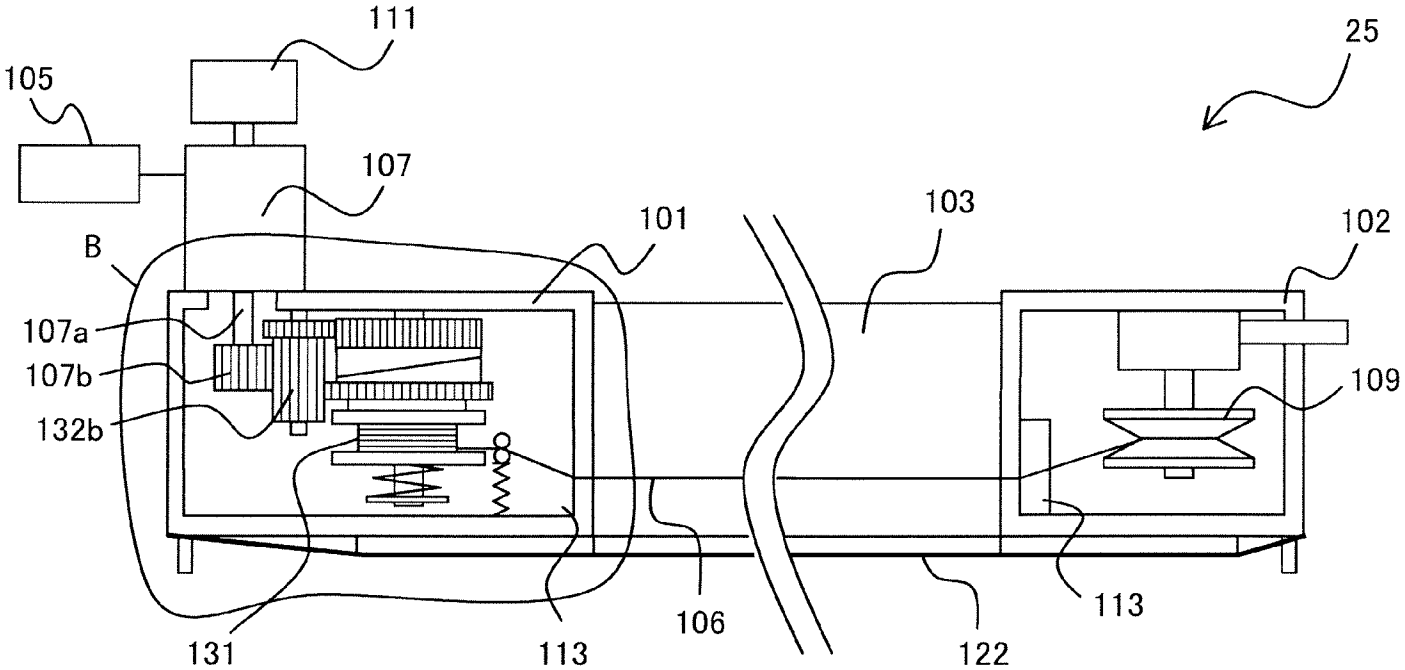
FIG. 13 is a schematic side view showing a primary charger according to Second Embodiment of the present invention.
Figure 14:
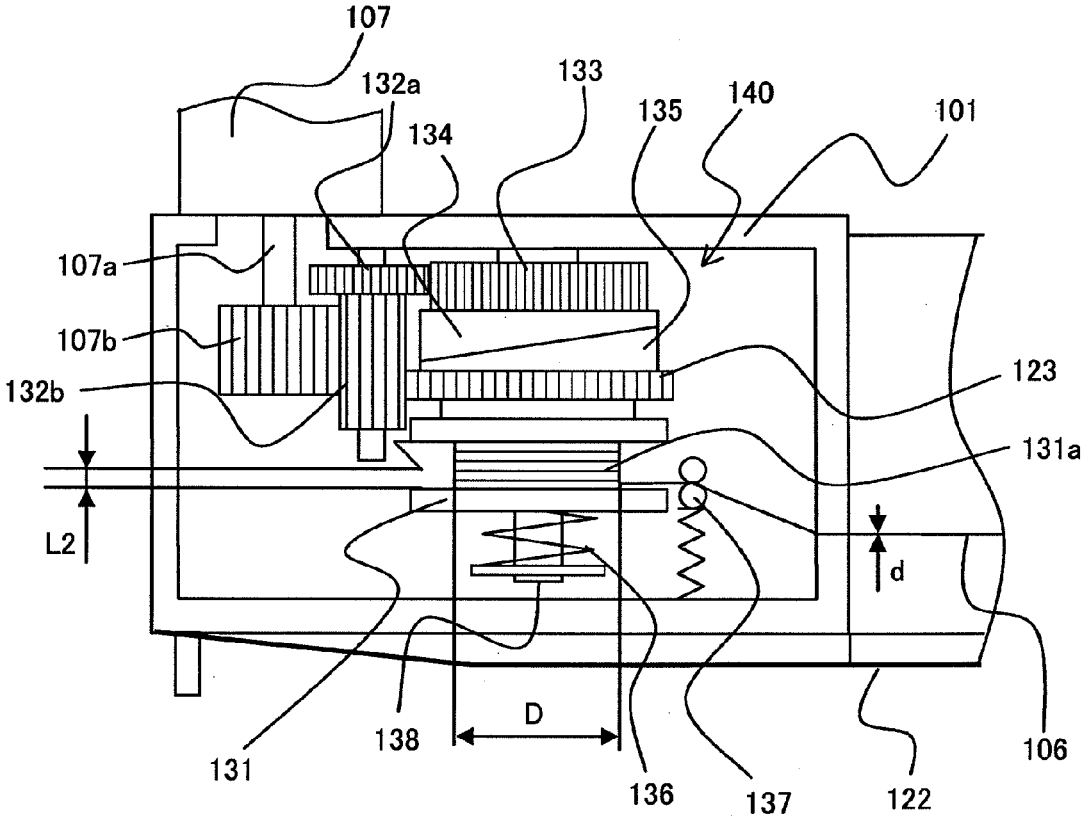
FIG. 14 is an enlarged view of a portion B indicated in FIG. 13.

A winding-up reel 131 in the drive-side case 101 is connected to a winding-up reel gear 123 as shown in FIGS. 13 and 14. Further, a driving force is transmitted from a motor gear 107*b*, connected to a rotation shaft 107*a* of the winding-up motor 107, to the winding-up reel gear 123 via an intermediate gear 132*b*. The winding-up reel 131 connected to the winding-up reel gear 123 is rotated to perform the winding-up of the charging wire 106. Further, the rotation of the rotation shaft 107*a* of the winding-up motor 107 is detected by a rotation sensor 111 as a rotation detecting means.

In this embodiment, the winding-up reel 131 includes a reel portion 131*a* which is a winding-up portion at which a plurality of charging wires 105 can be arranged in the rotational axis direction. Further, the winding-up reel 131 includes a reel up-and-down motion (vertical motion) unit 140 which is a reciprocal movement means which reciprocates the winding-up reel 131 in the rotational axis direction during the winding-up of the charging wires 106 by the winding-up reel 131 and which arranges the charging wires 106, at the reel portion 131*a*, in the rotational axis direction in parallel to each other. Further, the winding-up controller 105 controls the winding-up motor 107 so that the rotation amount of the winding-up reel 131 is decreased so as to be smaller than that before the movement direction of the reel up-and-down motion unit 140 is changed in the case where the movement direction of the reel up-and-down motion unit 140 is changed. Incidentally, in this embodiment, "vertical" means a direction of the reciprocal motion along the rotational axis direction.

More specifically, first, the reel portion 131*a* is formed so that a length thereof in the rotational axis direction is sufficiently larger than that in the groove 110*a* in First Embodiment, so that the plurality of charging wires 106 can be arranged in the rotational axis direction. That is, the reel portion 131*a* has a winding-up reel width L2 which is sufficiently larger than the wire diameter d of each charging wire 106. For that reason, compared with First Embodiment, the charging wire 105 can be wound up in a larger amount by the winding-up reel 131, so that this embodiment has the advantages such as a service life extension of the primary charger 25 and an increase of an interval of maintenance for exchanging the charging wire 106.

Further, the reel up-and-down motion unit 140 includes a reel up-and-down motion gear 133, an upper cam and a lower cam which are provided coaxially with the winding-up reel 131, and includes an up-and-down motion intermediate gear 132*a* which is provided coaxially with the intermediate gear 132*b*. The rotation shaft of the up-and-down motion intermediate gear 132*a* and the intermediate gear 132*b* is parallel to the rotation shaft of the winding-up reel 131, so that the up-and-down motion intermediate gear 132*a* engages with the reel up-and-down motion gear 133 and the intermediate gear 132*b* engages with the winding-up reel gear 123.

Further, the up-and-down motion intermediate gear 132*a* and the intermediate gear 132*b* are different in number of teeth. Similarly, the reel up-and-down motion gear 133 and the winding-up reel gear 123 are different in number of teeth. Therefore, when the driving force is transmitted from the motor 107 and thus the up-and-down motion intermediate gear 132*a* and the intermediate gear 132*b* are rotated, the reel up-and-down motion gear 133 and the winding-up reel gear 123 engaging with the intermediate gears 132*a* and 132*b*, respectively, are rotationally driven at different rotational speeds. In this embodiment, the winding-up reel gear 123 is set so that its rotational speed is sufficiently larger than that of the reel up-and-down motion gear 133. That is, the winding-up reel gear 123 is larger in number of teeth than the reel up-and-down motion gear 133. In summary, the upper cam 134 is much slower in rotational speed than the winding-up reel 131.

Further, the upper cam 134 and the lower cam 135 have cam surfaces where they oppose each other, and are disposed so that their cam surfaces contact each other. In this embodiment, each of the cam surfaces is inclined with respect to a surface perpendicular to the rotational axis direction at the same inclination angle. Further, the upper cam 134 is connected to the reel up-and-down motion gear 133, and the lower cam 135 is provided on the winding-up reel gear 123. Further, the upper cam 134 is rotated together with the reel up-and-down motion gear 133 but the lower cam 135 is not rotated together with the winding-up reel gear 123. Therefore, as described above, by the rotational drive of the reel up-and-down motion gear 133, the cam surfaces of the cams 134 and 135 are shifted (deviated) from each other, so that the upper cam 134 and the lower cam 135 are moved relative to each other in the rotational axis direction.

In this embodiment, the upper cam 134 and the reel up-and-down motion gear 133 cannot be moved in the rotational axis direction but the lower cam 135 and the winding-up reel gear 123 can be moved in the rotational axis direction. As a result, the winding-up reel 131 is moved in the rotational axis direction while being rotated. Incidentally, the length of the intermediate gear 123*b* in the rotational axis direction is increased so as to prevent the reel gear 123 from being disengaged from the intermediate gear 123*b* even when the reel gear 123 is moved in the rotational axis direction in such a manner.

Further, at a side of the winding-up reel 131 opposite from the side where the upper cam 134 is provided (at a lower portion of FIGS. 13 and 14), an up-and-down motion urging spring 136 is provided so as to urge the winding-up reel 131 toward the upper cam 134 (upward). As a result, the winding-up reel 131 connected to the winding-up reel gear 123 is moved in the rotational axis direction while being rotated, so that the winding-up position of the charging wire 106 is moved in the rotational axis direction.

Figure 15:
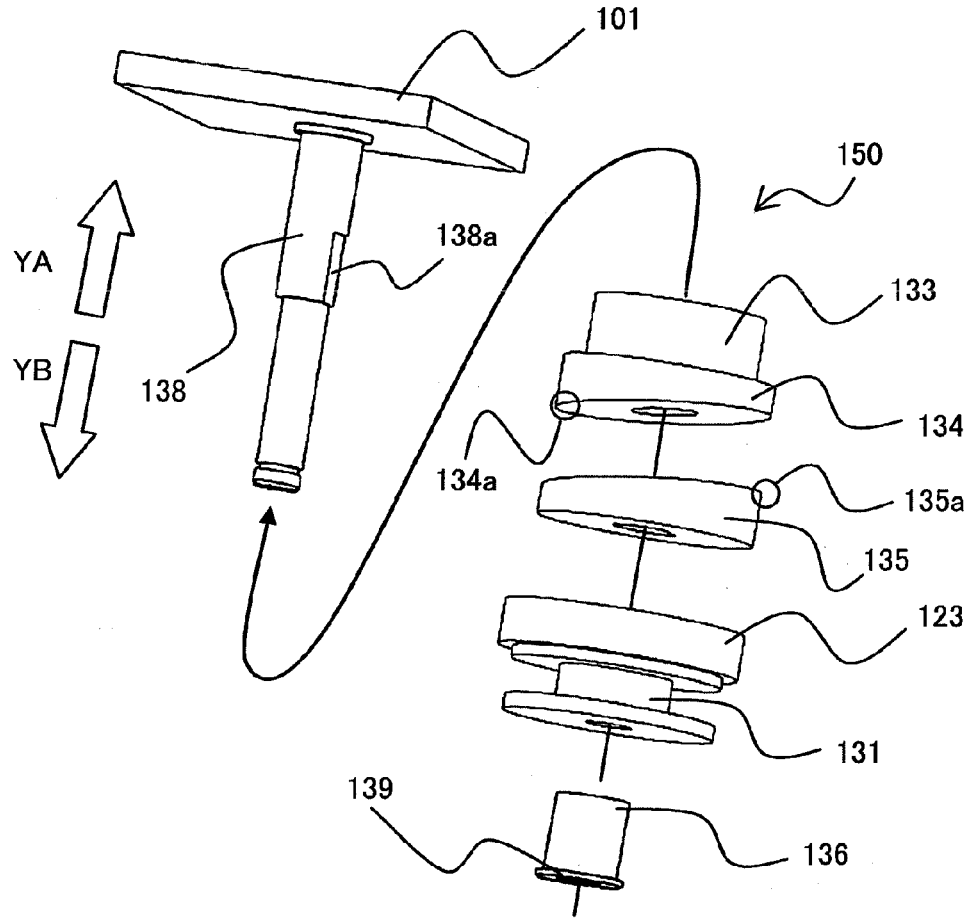
FIG. 15 is an exploded perspective view of a reel up-and-down motion unit.

The reel up-and-down motion unit 140 will be described in detail with reference to FIG. 15. As described above, the reel up-and-down motion gear 133 is connected to the upper cam 134 and the winding-up reel gear 123 is connected to the winding-up reel 131, and these members 133, 134, 123 and 131 are mounted on a winding-up shaft 138. The lower cam 135 is supported non-rotatably by a D-cut portion 138*a* of the winding-up shaft 138. On the other hand, the reel up-and-down motion gear 133, the upper cam 134, the winding-up reel gear 123 and the winding-up reel 131 are supported rotatably on the winding-up shaft 138.

At the lower portion of the winding-up reel 131, the up-and-down motion urging spring 136 is disposed, and a stopping ring 139 provided under the urging spring 136 is fixed at a groove 138*b* of the winding-up shaft 138. As a result, a part group 150 located above the stopping ring 139, such as the reel up-and-down motion gear 133 and the upper cam 134, and the up-and-down motion urging spring 136 are rotatably slidably or non-rotatably supported by the winding-up shaft 138. Further, the part group 150 is urged in an arrow YA direction by the up-and-down motion urging spring 136. For that reason, the upper cam 134 and the lower cam 135 are always in the contact state. The upper cam 134 has an upper cam projection 134*a* where the upper cam 134 is most projected in an arrow YB direction, and the lower cam 135 has a lower cam projection 135*a* where the lower cam 135 is most projected in the arrow YA direction.

[Charging Wire Winding-Up Operation]

Next, with reference to (a) to (d) of FIG. 16, the winding-up operation of the charging wire 106 in this embodiment will be described. Part (a) of FIG. 16 shows a state in which the upper cam projection 134*a* and the lower cam projection 135*a* are located symmetrically with respect to the winding-up shaft 138. For that reason, the winding-up reel 131 urged upward by the up-and-down motion urging spring 136 is in a state in which the winding-up reel 131 is disposed at a downstream-most position of the arrow YA direction. In the case where the upper cam 134 is located at this position, the charging wire 106 is set so as to be wound up at a lowest portion (downstreammost position of the arrow YB direction) of the reel portion 131*a* of the winding-up reel 131.

When the winding-up operation is started from the state of (a) of FIG. 16, the upper cam 134 is rotationally moved in an arrow YC direction, so that the upper cam projection 134*a* approaches the lower cam projection 135*a* and goes up along the inclined surface of the lower cam 135. Then, with gradual movement of the lower cam 135 in the YB direction, the winding-up reel 131 is also moved. A cam shape of the upper cam 134 and the lower cam 135 and the number of teeth of the gears 133 and 123 are set so that the movement amount in the YB direction at that time is increased with an increment of the wire diameter d of the charging wire 106 per (one) rotation of the winding-up reel 131.

The upper cam 134 is in a state of (c) of FIG. 16 via a state of (b) of FIG. 16 by further rotation. In the state of (c) of FIG. 16, the upper cam projection 134*a* reaches the lower cam projection 135*a* and thus the lower cam 135 and the winding-up reel 131 are disposed at the downstreammost position of the arrow YB direction. In this state, the charging wire 106 is set so as to be wound up at the highest portion (downstream-most position of the arrow YA direction) of the reel portion 131*a* of the winding-up reel 131.

When the upper cam 134 is further rotationally driven, the upper cam projection 134*a* is moved apart from the lower cam projection 135*a* and therefore the lower cam 135 and the winding-up reel 131 are urged in the arrow YA direction by the up-and-down motion urging spring 136, so that the state of the lower cam 135 and the winding-up reel 131 is returned to the state of (a) of FIG. 16 via a state of (d) of FIG. 16. In this way, by repeating the above operation by the upper cam 134 and the lower cam 135, the used charging wire 106 is uniformly wound up in the whole area of the reel portion 131*a* of the winding-up 131.

Next, the winding-up operation will be described based on numerical values used in this embodiment. The winding-up operation was performed under a condition that the charging wire diameter of the charging wire 106 was 0.1 mm, the reel width L2 of the winding-up reel 131 was 1 mm and the reel diameter was 15 mm. In this case, when the winding-up operation is started from the state of (a) of FIG. 16, the winding-up reel 131 is moved in the arrow YB direction by the upper cam 134. At that time, the winding-up position of the charging wire 106 is shifted by about 0.1 mm every one full circumference of the winding-up reel 131. Further, when the winding-up reel 131 reaches the position of (c) of FIG. 16, the charging wire 106 is wound up about the winding-up reel 131 in an amount corresponding to 10 times (L2/d=10), so that the reel diameter is changed from 15 mm (initial state) to 15.2 mm. As shown in FIG. 17, a vertical movement direction of the reel is switched every 10 times of rotation of the reel, that is, the movement direction of the reel up-and-down motion unit 140.

Next, a series of winding-up operations of the charging wire 106 by the winding-up reel 131 will be described with reference to FIGS. 18 to 20. Part (a) of FIG. 18 is a schematic view showing a state in which the charging wire 106 is uniformly wound up in the whole area of the reel portion 131*a* with the width of L2 by the winding-up reel 131. A sectional view of the reel portion 131*a* taken along F-F line indicated in (a) of FIG. 18 is shown in FIG. 19. A charging wire band 160 which is an assembly of the charging wire 106 is wound up with a width x by the winding-up reel 131 with a reel diameter $D_0$. The charging wire band 160 is the charging wire which has been used and collected until the state of the charging wire reaches the state of (a) of FIG. 18. Here, a reel diameter ($D_0$+2x) which is the sum of the reel diameter $D_0$ of the winding-up reel 131 and the width x of the charging wire band 160 is referred to as D(n).

In (a) of FIG. 18, the winding-up reel 131 is in a state in which the winding-up reel 131 is located at the downstream-most position with respect to the arrow YA direction (the state of (a) of FIG. 16). In this state, the charging wire 106 to be wound up by the winding-up reel 131 via the wire supporting member 137 is wound up at a lower limit position of the reel portion 131*a* as shown in (a) of FIG. 18. When the winding-up operation is started from the state of (a) of FIG. 18, the winding-up reel 131 is rotationally moved to collect the charging wire 106 and simultaneously is started to be moved in the arrow YB direction by the upper cam gear 134 described above.

Part (b) of FIG. 18 shows a state in which the winding-up operation is performed several times from the state of (a) of FIG. 18 (the state of (b) of FIG. 16). The reel diameter at a position where the charging wire 106 is newly wound up from the state of (a) of FIG. 18 is increased to (D(n)+2d) by the wire diameter d of the charging wire 106 as shown in FIG. 20. When the winding-up operation is further performed, as shown in (c) of FIG. 18, the winding-up reel 131 is in a state in which the winding-up reel 131 is located at the downstreammost position with respect to the arrow YB direction (the state of (c) of FIG. 16). In this state, the winding-up position of the charging wire 106 is the upper limit position of the reel portion 131*a*, so that the reel diameter in the whole area of the reel portion 131*a* is (D(n)+2d).

When the winding-up operation is further performed, as shown in (d) of FIG. 18, the winding-up reel 131 is moved in the arrow YA direction by the upper cam gear 134. At that time, the reel diameter at a new winding-up position is (D(n)+4d). That is, the reel diameter is increased with an increment of 2d (the number of laminations of the charging wire 106 with respect to the radial direction is increased)
every time when the winding-up position of the charging wire 106 reaches the upper limit position or the lower limit position of the reel portion 131*a*. The charging wire 106 is gradually wound up while repeating the operations described above with reference to (a) to (d) of FIG. 18.

Next, quantitative winding-up control of the charging wire 106 will be described. As described above, in the primary charger 25 in this embodiment, the reel diameter D(n) is increased every time when the winding-up position of the charging wire 106 reaches the upper limit position or the lower limit position of the reel portion 131*a* (with the winding-up width L2) of the winding-up reel 131. For that reason, in view of a relationship between the winding-up number and the reel diameter, there is a need to determine a proper rotation angle. The proper rotation number N of the winding-up reel 131 is obtained from the following equation (2). Incidentally, a portion in parenthesis ([ ]) means that the numerical value is an integer obtained by dropping the functional portion of the numerical value.

$$\theta=2\pi D_0/(D_0+2d\times[d\times n/L_2])[\text{rad}] \quad (2),$$

wherein θ represents the proper reel rotation angle, $D_0$ represents the initial reel diameter, $L_2$ represents a winding-up reel width, d represents the charging wire diameter and n represents the cumulative reel rotation number.

Here, the equation (2) will be described more specifically. Basically, the equation (2) is similar to the equation (1) described above but is different from the equation (1) in that the reel width $L_2$ is taken into consideration. That is, [n] in the equation (1) is changed to $[d\times n/L_2]$ in the equation (2). Therefore, $[d\times n/L_2]$ will be described.

First "d×n" represents the length of the charging wire 106 with respect to the rotational axis direction when the charging wire 106 is arranged in the rotational axis direction of the reel portion 131*a* at the cumulative winding-up number n. Therefore, $[d\times n/L_2]$ is 1 when [d×n] is equal to $L_2$. That is, $[d\times n/L_2]$ corresponds to the winding-up number of 1 in the equation (1). As described above, the numerical value in $[d\times n/L_2]$ is an integer obtained by dropping the fractional portion of the numerical value and therefore in the case where $[d\times n/L_2]$ is an integral multiple of $L_2$, the integer corresponds to the winding-up number in the equation (1). That is, $[d\times n/L_2]$ means that the reel diameter is increased in the case where the winding-up position of the charging wire 106 reaches the upper limit position or the lower limit position to switch the movement direction. Accordingly, every proper reel rotation angle θ obtained from the equation (2), the winding-up motor 107 is controlled, so that it is possible to perform the wire feeding in a constant amount.

FIG. 21 is an example of a flow chart for determining a rotation amount s of the winding-up reel 131 necessary to wind up the charging wire 106 in an intended winding-up amount M (e.g., a length of the charging wire 106 present in the range shown in FIG. 2) by the reel winding-up control in this embodiment. By rotating the winding-up reel 131 by the cumulative reel rotation amount s at the time until the operation reaches "END", it is possible to wind up the wire in the intended winding-up amount M or an amount close to the winding-up amount M. Incidentally, the winding-up amount M may also be, as described above, the whole length of the used charging wires 106*a* and 106*b*.

In the initial state, when the winding-up amount M is inputted into the winding-up controller 105 (S201), the cumulative rotation number n of the reel 131 and the rotation amount s of the reel 131 for winding up the wire in the winding-up amount M are reset in S202. Here, the initial state corresponds to, e.g., during product shipment, during exchange of the primary charger 25, and the like. Then, in S203, from the rotation number n (times) of the reel 131, the proper reel rotation angle θ and the apparent outer diameter $D_0$ of the reel 131 are obtained. Then, in S204, the rotation amount s (rad) of the reel 131 is accumulated to calculate a remaining winding-up amount M. In S205, whether or not the reel 131 is rotated one rotation or more in the remaining winding-up amount M is judged. In the case where the reel 131 is rotated one rotation or more, the rotation number n of the reel 131 is increased by 1 in S206, the operation is returned to S203. On the other hand, when the rotation number of the reel is less than 1 in S205 and in other words, in the case where the remaining winding-up amount M is less than the winding-up amount when the reel 110 is rotated one rotation, the calculation is ended and the rotation amount s at that time is the rotation amount s to be obtained. Incidentally, the flow chart shown in FIG. 21 is basically the same as that shown in FIG. 12 except that only the processing in S203 is different. Therefore, other points described with reference to FIG. 12 are also applicable to the flow chart of FIG. 21.

In this embodiment, compared with First Embodiment, the charging wire 105 can be wound up in a larger amount by the winding-up reel 131, so that this embodiment has the advantages such as a service life extension of the primary charger 25 and an increase of an interval of maintenance for exchanging the charging wire 106. Incidentally, in the above description, the winding-up reel 131 is moved by the reel up-and-down motion unit 140 but the charging wire 106 may also be moved relative to the winding-up reel 131. In summary, during the winding-up of the charging wire 106 by the winding-up reel 131, the winding-up reel 131 and the charging wire 106 may only be required to be reciprocated relative to each other in the rotational axis direction of the winding-up reel 131. Other constitutions and functions are similar to those in First Embodiment.

Third Embodiment

Third Embodiment of the present invention will be described with reference to FIG. 22. Hereinbelow, a constitution different from that in First and Second Embodiments will be principally described and description of a constitution similar to those of First and Second Embodiments will be omitted or simplified.

The primary charger 25 in this embodiment has a constitution in which a single charging wire 106 is used without being turned back. For this reason, the feeding reel 108 is disposed in the electrode-side case 102. Further, to the feeding reel 108, a high-voltage source 104 is connected. Further, similarly as in First and Second Embodiments, the feeding reel 108 incorporates therein the torque limiter 150 as shown in FIG. 5.

Also in such a constitution, by the winding-up of the charging wire 106, the apparent outer diameter of the winding-up reel 110 is increased to increase the winding-up amount and therefore there is a possibility that the wire is not completely used, so that the application of the present invention is effective. As the wire winding-up control, it is also possible to employ the same control as in First or Second Embodiment based on the constitution of the winding-up reel 110.

Other Embodiments

In the embodiments described above, the constitution in which the present invention is applied to the primary charger is described, but the present invention is also applicable to other corona dischargers such as the transfer charger 20 and the separation charger 21. As a result, it is possible to suppress occurrences of the improper transfer and the improper separation. Further, in the above-described embodiments, the present invention is applied to a single color image forming apparatus, but is also applicable to an image forming apparatus for forming a plurality of color images, such as a full-color image forming apparatus.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 259018/2010 filed Nov. 19, 2010, which is hereby incorporated by reference.

What is claimed is:

1. A corona discharger, including a shield and a charging wire provided in the shield, for generating corona discharge by applying a voltage to the charging wire, said corona discharger comprising:

winding-up means for winding up the charging wire by rotation thereof to move the charging wire in the shield;

driving means for rotationally driving said winding-up means;

rotation detecting means for detecting the rotation of said winding-up means; and control means for controlling said driving means so that a cumulative rotation amount is counted on the basis of a detection result of said rotation detecting means and then a rotation amount of said winding-up means per unit winding-up length of the charging wire is decreased with an increase of the cumulative rotation amount.

2. A discharger according to claim 1, wherein said winding-up means includes a winding-up portion capable of arranging a plurality of wires of the charging wire in a rotational axis direction, wherein said corona discharger further comprises reciprocal movement means for causing relative reciprocal movement between said winding-up means and the charging wire in the rotational axis direction during winding-up of the charging wire by said winding-up means to arrange the wires of the charging wire in the rotational axis direction at said winding-up portion, and wherein said control means controls, when a movement direction of said reciprocal movement means is changed, said driving means so that a rotation amount of said winding-up means is smaller than that before the movement direction is changed.

3. An image forming apparatus comprising:

an image bearing member for bearing a toner image; and a corona discharger, for electrically charging said image bearing member, according to claim 1.

* * * * *